US007779860B2

(12) United States Patent
Pears

(10) Patent No.: US 7,779,860 B2
(45) Date of Patent: Aug. 24, 2010

(54) AIRFLOW CONTROL MECHANISM

(75) Inventor: Barry Pears, Langley Moor (GB)

(73) Assignee: Black & Decker Inc., Newark, DE (US)

( * ) Notice: Subject to any disclaimer, the term of this patent is extended or adjusted under 35 U.S.C. 154(b) by 596 days.

(21) Appl. No.: 11/705,667

(22) Filed: Feb. 13, 2007

(65) Prior Publication Data

US 2007/0199605 A1 Aug. 30, 2007

(30) Foreign Application Priority Data

Feb. 20, 2006 (EP) ..... 06110161

(51) Int. Cl.
*F16K 11/06* (2006.01)

(52) U.S. Cl. ..... 137/556; 15/375; 15/421; 137/625.41; 251/340; 251/345

(58) Field of Classification Search ..... 137/556, 137/625.41, 893, 625.31; 15/375, 421; 251/340, 251/344, 345

See application file for complete search history.

(56) References Cited

U.S. PATENT DOCUMENTS

| | | | | | |
|---|---|---|---|---|---|
| 159,142 | A | * | 1/1875 | Baird | 137/893 |
| 733,091 | A | * | 7/1903 | Taylor | 431/355 |
| 2,585,835 | A | * | 2/1952 | Preiss | 48/180.1 |
| 3,005,468 | A | * | 10/1961 | Erwin et al. | 251/344 |
| 3,033,226 | A | * | 5/1962 | Allen | 251/344 |
| 3,381,328 | A | | 5/1968 | Szabo | |
| 3,566,921 | A | | 3/1971 | Bell et al. | |

(Continued)

FOREIGN PATENT DOCUMENTS

SE 9801254 L 10/1999

*Primary Examiner*—Stephen Hepperle
(74) *Attorney, Agent, or Firm*—John Yun; Bruce S. Shapiro; Stephen Valancius

(57) ABSTRACT

The present invention provides an airflow control mechanism comprising a conduit for air having an inlet located at a first end thereof and an outlet located at a second end thereof; a first opening formed in a side of said conduit and able to provide a secondary inlet thereto; a movable collar at least partially surrounding said conduit at a location alignable with said first opening, such that said collar is able to at least partially occlude said first opening; further comprising a second opening beside the first opening as part of the secondary inlet, wherein the collar is also alignable with the second opening, such that the collar is able to at least partially occlude the second opening at the same time as the first opening. Thus with this airflow control mechanism, a user may select whether to occlude both the first and the second openings, in which case air will pass directly from the inlet to the outlet without any air also entering through the secondary inlet, or to occlude neither the first and second openings, in which case air entering the secondary inlet will contribute to the total amount of air exiting the outlet, or to occlude just one of the first and second openings, in which case, a fixed amount of air which is less than the secondary inlet being fully open, but more than the secondary inlet being fully closed, will enter through the secondary inlet and contribute to the total amount of air exiting the outlet. Thus the user will be provided with a highly predictable and repeatable setting for the airflow control mechanism between the fully open and fully closed positions of the secondary inlet.

9 Claims, 4 Drawing Sheets

U.S. PATENT DOCUMENTS 3,633,239 A 1/1972 Meyerhoefer
3,913,607 A * 10/1975 Price ..... 137/271
5,050,266 A * 9/1991 Schneider ..... 15/421
5,178,187 A * 1/1993 Raymond et al. ..... 137/556
5,704,090 A 1/1998 Berfield et al.
2005/0050680 A1 3/2005 Anderson et al.

* cited by examiner

AIRFLOW CONTROL MECHANISM

FIELD OF THE INVENTION

The present invention concerns a mechanism for controlling the airflow in an airflow pathway. It is particularly applicable to the airflow pathway in a vacuum cleaner, but is equally applicable to the airflow pathway in any air-moving system requiring control.

BACKGROUND OF THE INVENTION

In conventional vacuum cleaners, an airflow pathway comprises an inlet for dirty air, which is provided for example as part of a floor-cleaning head, an outlet for clean air and a source of suction power. The source of suction power, which is typically a motor and a fan driven by the motor, generates a pressure differential between the dirty air inlet and the clean air outlet, which draws air in through the inlet and expels the air through the outlet. A filter or other separation device such as a cyclone located in fluid communication between the inlet and the outlet separates out dust and dirt from the air as it passes along the airflow pathway. In conventional vacuum cleaners, the size of the pressure differential and therefore the strength of suction generated at the dirty air inlet is usually modulated in one of two ways, as follows.

Firstly, a second inlet for clean air may be provided to the airflow pathway which can be opened and closed by a user as desired. This second inlet typically takes the form of a bleed valve provided on a wand of the vacuum cleaner having the inlet for dirty air located at one end thereof. Thus as the bleed valve is opened by the user, air is drawn into the airflow pathway by the source of suction power through both the inlet for dirty air and the second, clean air inlet. Since the strength of the source of suction power itself has not changed, the total rate of air movement (i.e. volume of air moved per unit time) through the vacuum cleaner does not change either. Accordingly, the volume of air entering the dirty air inlet per unit time drops in order to accommodate the increased volume of air also entering the airflow pathway through the second, clean air inlet. This first technique for modulating the size of the pressure differential between the dirty air inlet and the clean air outlet has the advantage that it is cheap and simple to manufacture. However, it also has the disadvantage that it gives little control to the user beyond two settings in which the bleed valve is either open or closed. In order to alleviate this problem somewhat, a more sophisticated version of the bleed valve may also allow the size of the second, clean air inlet to be varied but this gives little precise control to the user.

In a second technique for modulating the size of the pressure differential between the dirty air inlet and the clean air outlet, the source of suction power is instead provided with a mechanism for adjusting the amount of power supplied to the motor. Accordingly, the strength of the source of suction power is itself changed and the total rate of air movement through the vacuum cleaner changes with it. Thus as the motor power adjustment mechanism is operated by a user, the volume of air entering the dirty air inlet per unit time varies in proportion to the amount of power supplied to the motor. The mechanism for adjusting the amount of power supplied to the motor typically takes the form of a rheostat or a switch having several different power settings which the user may select, and may also incorporate some control electronics as well. This second technique has the advantage that the mechanism allows for sophisticated and precise control of the volume of air entering the dirty air inlet by the user, but it also has the disadvantage that it is more expensive and difficult to manufacture than a bleed valve. Because of its greater degree of complication, it is also more liable to malfunction than a bleed valve.

BRIEF SUMMARY OF THE INVENTION

Consequently, there is a need for an airflow control mechanism which is both cheap and simple to manufacture and reliable in operation like a conventional bleed valve, but which gives a high degree of precise control to a user like a motor power adjustment mechanism. An object of the present invention is to address this need. Accordingly, the present invention provides an airflow control mechanism comprising a conduit for air having an inlet located at a first end thereof and an outlet located at a second end thereof; a first opening formed in a side of said conduit and able to provide a secondary inlet thereto; a movable collar at least partially surrounding said conduit at a location alignable with said first opening, such that said collar is able to at least partially occlude said first opening; further comprising a second opening beside the first opening as part of the secondary inlet, wherein the collar is also alignable with the second opening, such that the collar is able to at least partially occlude the second opening at the same time as the first opening. Thus with this airflow control mechanism, a user may select whether to occlude both the first and the second openings, in which case air will pass directly from the inlet to the outlet without any air also entering through the secondary inlet, or to occlude neither the first and second openings, in which case air entering the secondary inlet will contribute to the total amount of air exiting the outlet, or to occlude just one of the first and second openings, in which case, a fixed amount of air which is less than the secondary inlet being fully open, but more than the secondary inlet being fully closed, will enter through the secondary inlet and contribute to the total amount of air exiting the outlet. Thus the user will be provided with a highly predictable and repeatable setting for the airflow control mechanism between the fully open and fully closed positions of the secondary inlet.

Preferably, the second opening is of the same shape and size as the first opening. In this case, the predictable and repeatable setting for the airflow control mechanism will be at the midpoint between the fully open and fully closed positions.

More preferably still, the first and second openings are two of a plurality of openings of the same shape and size as each other arranged in a row in a side of the conduit, and the collar is able to at least partially occlude successive ones of the plurality of openings at the same time as each other. In this case, the airflow control mechanism then exhibits a plurality of highly predictable and repeatable settings spaced at regular intervals between the fully open and fully closed positions of the secondary inlet.

The airflow control mechanism may further comprise a pointer and a plurality of indicia, the pointer being selectively alignable with a respective one of the indicia, each position of the pointer corresponding to a particular setting of the airflow control mechanism between the fully open and fully closed configurations of the secondary inlet. In a preferred embodiment, movement of the collar is restricted by a pair of end-stops between a minimum and a maximum position of the collar. A further preferred feature of the invention is that the collar should also be provided with a plurality of channels each alignable with a corresponding one of the openings of the secondary inlet and having a shape and size appropriate to guide air smoothly into said openings.

BRIEF DESCRIPTION OF THE DRAWINGS

Further features and advantages of the present invention will become apparent from the following detailed description, which is given by way of example and in association with the accompanying drawings, in which.

DETAILED DESCRIPTION OF THE INVENTION

Figure 1A:
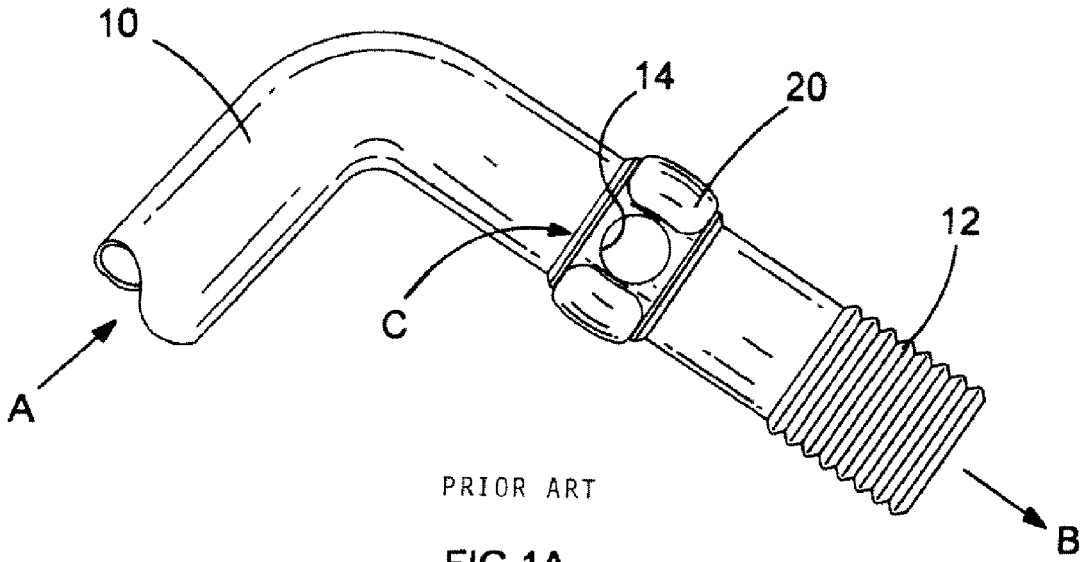
PRIOR ART FIG.1A
FIG. 1A schematically shows part of a vacuum cleaner wand comprising a prior art bleed valve in a first, fully open configuration thereof.
Figure 1B:
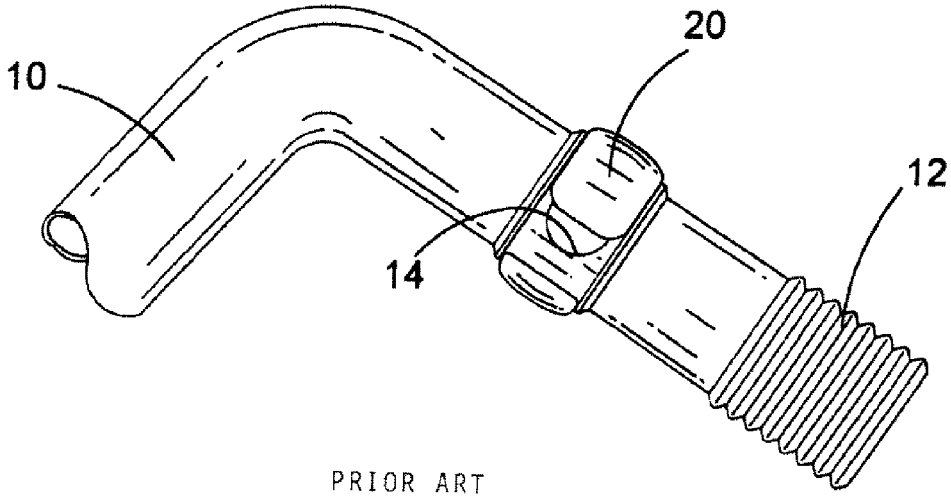
PRIOR ART FIG.1B
FIG. 1B schematically shows the same part of the wand as FIG. 1A, wherein the bleed valve is in a second, partially open configuration thereof.
Figure 1C:
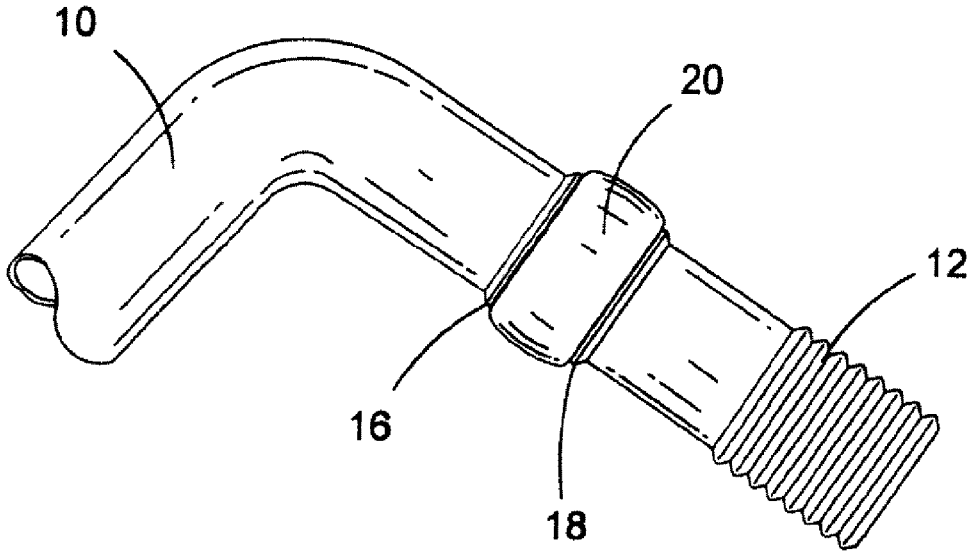
FIG.1C PRIOR ART
FIG. 1C schematically shows the same part of the wand as FIG. 1A, wherein the bleed valve is in a third, closed configuration thereof.

Referring firstly to FIG. 1A, there is shown part of a vacuum cleaner wand comprising a prior art bleed valve. The wand comprises a rigid tubular portion 10 and a flexible hose portion 12. An end of the rigid tubular portion 10 remote from the flexible hose portion 12 is provided with an inlet for dirty air (not shown), for example as part of a floor-cleaning head. An end of the flexible hose portion 12 remote from the rigid tubular portion 10 is in turn connected to a vacuum cleaner body (also not shown). Thus during operation of the vacuum cleaner, dirty air enters the rigid tubular portion 10 in the direction indicated in FIG. 1A by arrow A and exits the flexible hose portion 12 in the direction indicated in FIG. 1A by arrow B. An opening 14 is also formed in rigid tubular portion 10, which provides a second inlet for clean air. This enters the wand during operation of the vacuum cleaner in the direction indicated in FIG. 1A by arrow C. Rigid tubular portion 10 further comprises two annular ridges 16, 18 formed thereon (see FIG. 1C). Trapped between ridges 16, 18 is a rotatable collar 20. Opening 14, ridges 16, 18 and rotatable collar 20 together constitute the bleed valve. Rotatable collar 20 does not completely encircle rigid tubular portion 10, but rather has a break formed therein, so that the collar 20 only encompasses about 300 degrees around the circumference of rigid tubular portion 10. Thus a user may manually adjust the position of rotatable collar 20 such that the break in collar 20 is aligned with the position of opening 14, as shown in FIG. 1A. In this first configuration, the bleed valve is fully open. Alternatively, the user may also manually adjust the position of collar 20 such that it partially covers opening 14, as shown in FIG. 1B or such that opening 14 is completely covered by collar 20, as shown in FIG. 1C. In this position, the bleed valve is fully closed. In the intermediate position indicated in FIG. 1B, some air may enter opening 14 and the bleed valve is partially open.

Figure 2A:
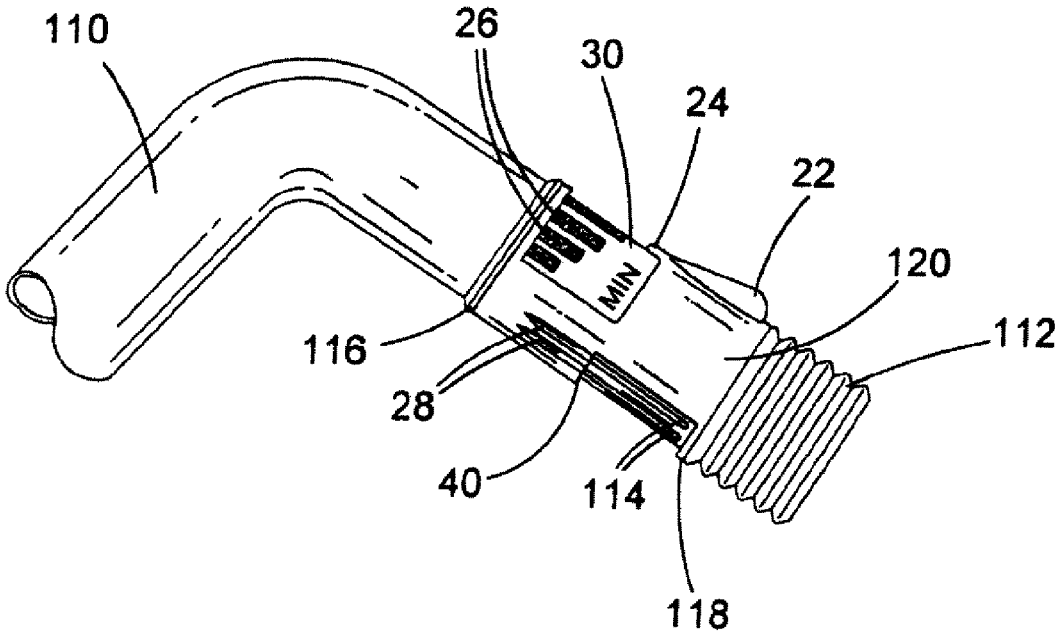
FIG. 2A schematically shows a side view of part of a vacuum cleaner wand comprising a bleed valve according to an embodiment of the present invention.

Turning now to FIG. 2A, there is shown a side view of part of a vacuum cleaner wand comprising a bleed valve according to an embodiment of the invention, in which parts similar to those of the bleed valve illustrated in FIGS. 1A, 1B and 1C are denoted by like reference numerals to those used in FIGS. 1A, 1B and 1C, but increased by 100. The bleed valve shown in FIG. 2A therefore comprises a rotatable collar 120 held between two annular ridges 116, 118 of rigid tubular portion 110, although unlike the rotatable collar 20 of the bleed valve shown in FIGS. 1A, 1B and 1C, collar 120 completely encircles rigid tubular portion 110. Instead, rotatable collar 120 has two windows 30 and 40 respectively formed in top and underneath sides thereof, which expose parts of rigid tubular portion 110. As may best be seen in FIG. 2B, the part of rigid tubular portion 110 exposed by window 30 is marked with indicia 26. On the other hand, as may best be seen in FIG. 2B, the part of rigid tubular portion 110 exposed by window 40 comprise a plurality of openings 114. Collar 120 is further provided with a lever 22 moulded integrally therein, which allows a user to rotate collar 120 by pushing on lever 22 in either of the directions indicated in FIG. 2B by the arrows labelled E and F. Lever 22 also ends in a pointer 24, which protrudes into window 30, as may be seen in FIGS. 2A and 2B. Thus as a user rotates collar 120 by pushing on lever 22 in either of these directions, pointer 24 points at successive ones of the indicia 26 marked on the part of rigid tubular portion 110 exposed by window 30. At the same time, window 40 exposes either more or fewer of the plurality of openings 114, one by one. As shown in FIG. 2C, rotatable collar 120 is further provided with a plurality of channels 28 formed on the underside thereof. Channels 28 have a width and spacing which together give them a pitch equal to that of openings 114, and are equal in number to the total number of openings 114. Thus during operation of the vacuum cleaner, air drawn into openings 114 in the direction indicated in FIG. 2C by the arrows labelled D and D' is directed into openings 114 by corresponding channels 28. This is advantageous in providing a smoother air flow into openings 114, which greatly helps to reduce noise that would otherwise be generated by air rushing into openings 114. FIG. 3 illustrates the profile of channels 28 looking in the direction of arrow G in FIG. 2C from a location within window 40, although not to the same scale.

Figure 2B:
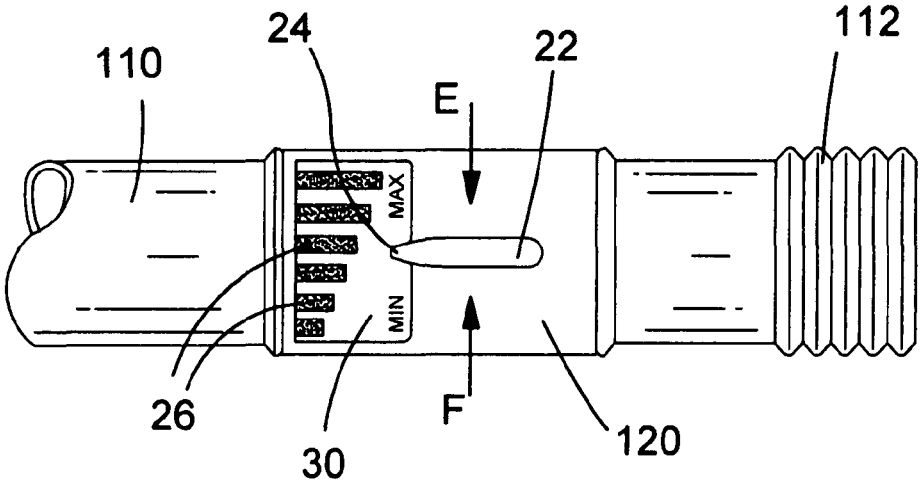
FIG. 2B schematically shows a top plan view of the same part of the wand as in FIG. 2A.
Figure 2C:
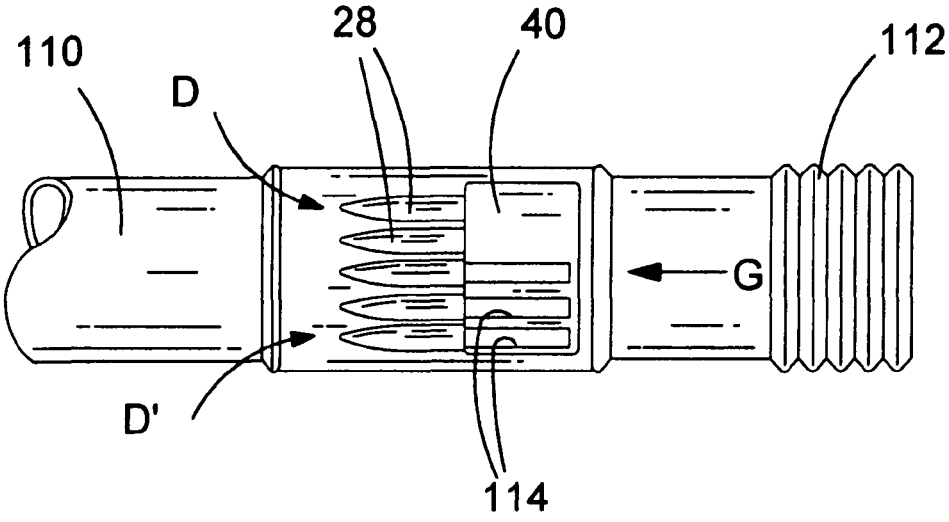
FIG. 2C schematically shows an underneath view of the same part of the wand as in FIG. 2A.
Figure 3:
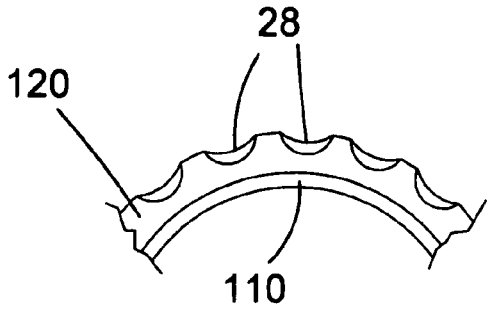
FIG. 3 schematically shows an end-on view of part of a rotatable collar already represented in FIGS. 2A, 2B and 2C, looking in the direction of an arrow labelled G in FIG. 2C from a location within a window of the rotatable collar also shown therein.
Figure 4A:
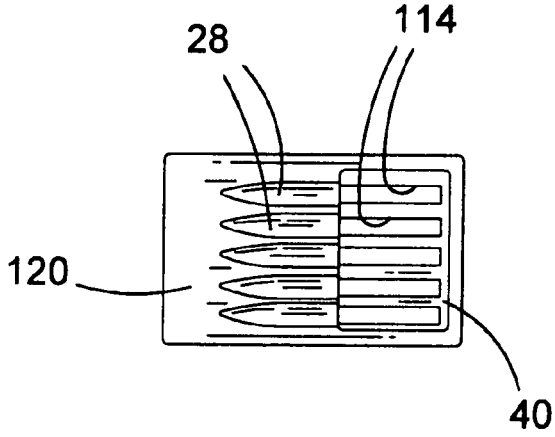
FIG. 4A schematically shows the appearance of the underside of the rotatable collar in a fully open configuration thereof.
Figure 4B:
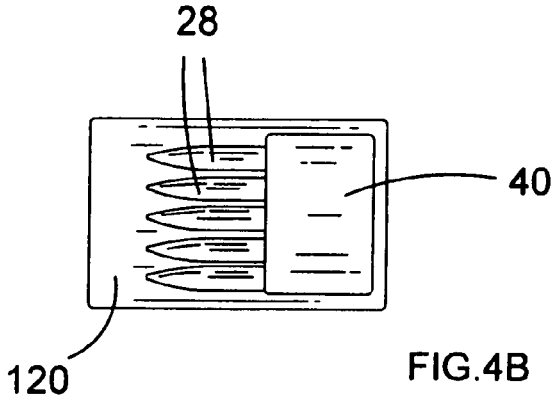
FIG. 4B schematically shows the appearance of the underside of the rotatable collar in a fully closed configuration thereof.

All of FIGS. 2A, 2B and 2C show the bleed valve in the half-open position, wherein the pointer 24 is centrally located between the minimum and maximum positions represented by indicia 26, and only half of the total number of openings 114 are exposed by window 40. Accordingly, FIGS. 4A and 4B respectively show the appearance of the underside of collar 120 when pointer 24 is in the minimum and maximum positions thereof. As may be seen in FIG. 4A, when pointer 24 is in the minimum position represented by indicia 26, all of the openings 114 equal in number to channels 28 are exposed by window 40. Since all of the openings 114 are exposed, the maximum volume of clean air enters through the bleed valve and the minimum volume of dirty air enters through the dirty air inlet to the vacuum cleaner wand; hence this represents the minimum position for suction power at the dirty air inlet. On the other hand, as may be seen in FIG. 4B, when pointer 24 is in the maximum position represented by indicia 26, none of the openings 114 are exposed by window 40. In this case, since none of the openings are exposed, no clean air can enter through the bleed valve and all the air enters the wand through the dirty air inlet; hence this represents the maximum position for suction power at the dirty air inlet. A user is therefore able to select, in a stepwise fashion corresponding to how many of openings 114 are exposed by window 40, how much to open the bleed valve between the fully open position shown in FIG. 4A and the fully closed position shown in FIG. 4B.

Figure 5:
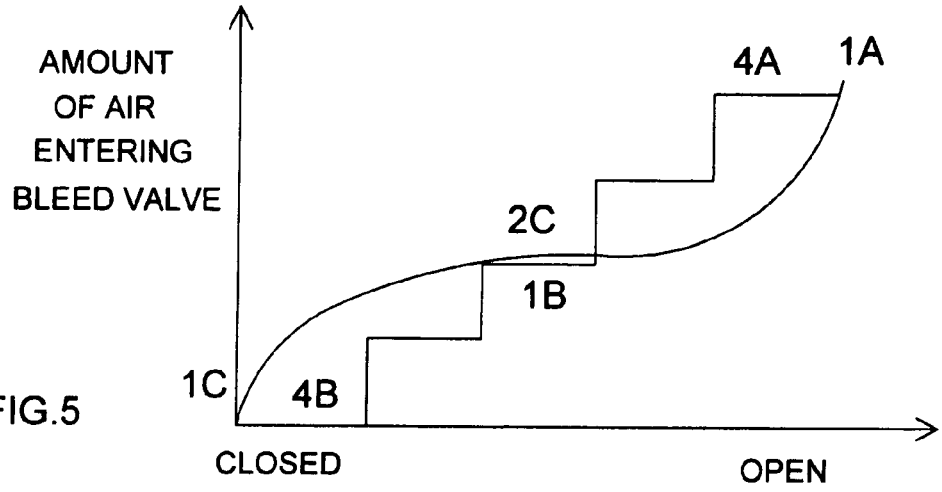
FIG. 5 is a graph representing the relative performance of the bleed valves of FIGS. 1A, 1B and 1C on the one hand and FIGS. 2A, 2B and 2C on the other.

FIG. 5 is a graph contrasting the performance of the bleed valve shown in FIGS. 2A, 2B and 2C with that of the prior art bleed valve shown in FIGS. 1A, 1B and 1C, wherein the ordinate measures the amount of air entering each bleed valve and the abscissa measures the amount by which each valve is opened. In FIG. 5, the smooth curve indicates the performance of the prior art bleed valve and the stepped line indicates the performance of the bleed valve shown in FIGS. 2A, 2B and 2C. The configurations of both bleed valves at different locations on the graph are also indicated by the numbers of the corresponding figures provided at these locations. As may be seen from FIG. 5, since opening 14 in the prior art bleed valve has a circular profile, opening this valve produces a very rapid increase in the amount of air entering the valve initially, giving very little control. However, when the prior art bleed valve reaches approximately half-open, opening or closing the valve further produces very little change in the amount of air entering the valve, and the valve is therefore very unresponsive. Finally, when the prior art bleed valve approaches the fully closed position, the amount of air entering the valve again changes very rapidly, and fine control is lost once more. In contrast, with the bleed valve shown in FIGS. 2A, 2B and 2C, the amount of air entering the valve always increases at the same, steady rate according to how many of openings 114 are exposed by window 40.

The bleed valve shown in FIGS. 2A, 2B and 2C is also provided with end-stops not shown in the drawings, which ensure that collar 120 cannot be rotated beyond the minimum and maximum positions represented by indicia 26. The number of openings 114 and channels 28 represented in the drawings is also purely illustrative and can be increased or decreased as desired.

In a second, alternative embodiment not shown in the drawings, collar 20, rather than being rotatable about rigid tubular portion 110, may instead slide up and down the rigid tubular portion between minimum and maximum positions similarly determined by end-stops. These end-stops are provided by annular ridges 116, 118 located on rigid tubular portion 110 at a separation from each other greater than the length of collar 20. On the other hand, the collar is prevented from rotating about the rigid tubular portion by a longitudinal groove formed on an inner surface of the collar, which engages with a rail also formed lengthwise on an outer surface of the rigid tubular portion. In this alternative embodiment, the lever 22, pointer 24, indicia 26 and window 30 on top of the collar, as well as the openings 114, channels 28 and window 40 on the underneath thereof, rather than all being aligned with the longitudinal axis of the rigid tubular portion, are instead all aligned transversely thereto. Thus as the collar is slid by a user up and down the rigid tubular portion, successive ones of the openings are exposed by window 40. The overall effect of this alternative embodiment during operation of the vacuum cleaner is therefore identical to that of the first embodiment, and produces the same results as those for the first embodiment already illustrated in FIG. 5.

The invention claimed is:

1. An airflow control mechanism comprising:

a conduit for air having an inlet located at a first end thereof and an outlet located at a second end thereof;

a first opening formed in a side of said conduit and able to provide a secondary inlet thereto;

a movable collar at least partially surrounding said conduit at a location alignable with said first opening, such that said collar is able to at least partially occlude said first opening;

characterized by:

a second opening beside the first opening as part of the secondary inlet, wherein the collar is also alignable with said second opening, such that said collar is able to at least partially occlude said second opening at the same time as said first opening; and wherein the collar is provided with a plurality of channels ending in a window, each channel alignable with a corresponding one of said openings of the secondary inlet, said channels having a scalloped shape and extending in a direction parallel to an axis of said collar to appropriately guide air smoothly into said openings.

2. An airflow control mechanism according to claim 1, wherein the second opening is of the same shape and size as the first opening.

3. An airflow control mechanism according to claim 2, wherein the first and second openings are two of a plurality of openings of the same shape and size as each other arranged in a row in a side of said conduit, and said collar is able to at least partially occlude successive ones of said plurality of openings at the same time as each other.

4. An airflow control mechanism according to claim 1, further comprising a pointer and a plurality of indicia, the pointer being selectively alignable with a respective one of the indicia, each position of the pointer corresponding to a particular setting of the airflow control mechanism between fully open and fully closed configurations of the secondary inlet.

5. An airflow control mechanism according to claim 1, wherein movement of the collar is restricted by a pair of end-stops between a minimum and a maximum position of said collar.

6. An airflow control mechanism according to claim 1, wherein the movable collar (120) is rotatable about said conduit and said openings are arranged around a diameter of said conduit.

7. An airflow control mechanism according to claim 4, wherein said pointer is provided on said collar, said indicia are provided on said conduit, and said collar comprises a first window to reveal said indicia as said collar is moved.

8. An airflow control mechanism according to claim 7, wherein said collar comprises a second window selectively alignable to occlude one or more of said openings.

9. An airflow control mechanism according to claim 1, wherein said collar further comprises a lever for moving said collar.

* * * * *